US008516875B1

(12) United States Patent
Chan

(10) Patent No.: US 8,516,875 B1
(45) Date of Patent: Aug. 27, 2013

(54) REPAIRING KIT FOR AUTOMOTIVE DENTS

(71) Applicant: Yi-Chang Chan, New Taipei (TW)

(72) Inventor: Yi-Chang Chan, New Taipei (TW)

( * ) Notice: Subject to any disclaimer, the term of this patent is extended or adjusted under 35 U.S.C. 154(b) by 0 days.

(21) Appl. No.: 13/691,783

(22) Filed: Dec. 1, 2012

(51) Int. Cl.
*B21J 9/18* (2006.01)
*B21D 1/06* (2006.01)

(52) U.S. Cl.
USPC ..... 72/457; 72/389.1; 72/390.4; 72/390.5; 72/451; 72/458; 72/705; 29/267

(58) Field of Classification Search
USPC ..... 72/389.1, 390.04, 390.05, 409.1, 72/447, 451, 458, 705, 390.4, 390.5; 29/267
See application file for complete search history.

(56) References Cited

U.S. PATENT DOCUMENTS

| | | | | |
|---|---|---|---|---|
| 2,949,144 | A * | 8/1960 | Dredske et al. | 72/390.2 |
| 3,977,230 | A * | 8/1976 | Jones | 72/325 |
| 4,050,271 | A * | 9/1977 | Jones | 72/37 |
| 4,116,035 | A * | 9/1978 | Malarsky | 72/389.6 |
| 4,930,335 | A * | 6/1990 | Ishihara | 72/451 |
| 5,943,902 | A * | 8/1999 | Ishihara | 72/451 |
| 6,874,347 | B2 * | 4/2005 | Meichtry | 72/458 |

* cited by examiner

*Primary Examiner* — David B Jones
(74) *Attorney, Agent, or Firm* — Pro-Techtor Int'l Services

(57) ABSTRACT

A repairing kit for automotive dents includes a body, a draw bar, a spring, a pull seat, a pull piece, a grab bar, a handle, two foot stands and two foot pieces. The repairing kit can be used to repair automotive dents and restore a smooth surface to an automobile using a DIY method, without damaging the baking finish surface after repairing the automotive dent.

4 Claims, 4 Drawing Sheets

REPAIRING KIT FOR AUTOMOTIVE DENTS

BACKGROUND OF THE INVENTION a) Field of the Invention

The present invention relates to a repairing kit for automotive dents, and more particularly to a repairing kit that can be used to completely repair auto body cavities by a DIY (Do It Yourself) method.

b) Description of the Prior Art

Dents are created on a general automobile when the automobile is hit by small rocks or foreign objects. An owner of the car cannot repair by to a DIY method, and has to rely on an auto repair shop to repair the dents. Nevertheless, the majority of repair procedures taken by the auto repair shop include first hammering out the automotive dent cavity to restore it to a smooth surface, and then implementing a baking finish on the surface of the car body, which is both time consuming and very troublesome.

There are a few USA patents that mention a repairing kit for automotive dents, including U.S. Pat. Nos. 1,457,570, 169, 646, 5,203,196 and 5,934,139. Nevertheless, all the abovementioned patents are different from the present invention.

SUMMARY OF THE INVENTION

The primary object of the present invention is to provide a repairing kit that can be used to repair automotive dents by a DIY method.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
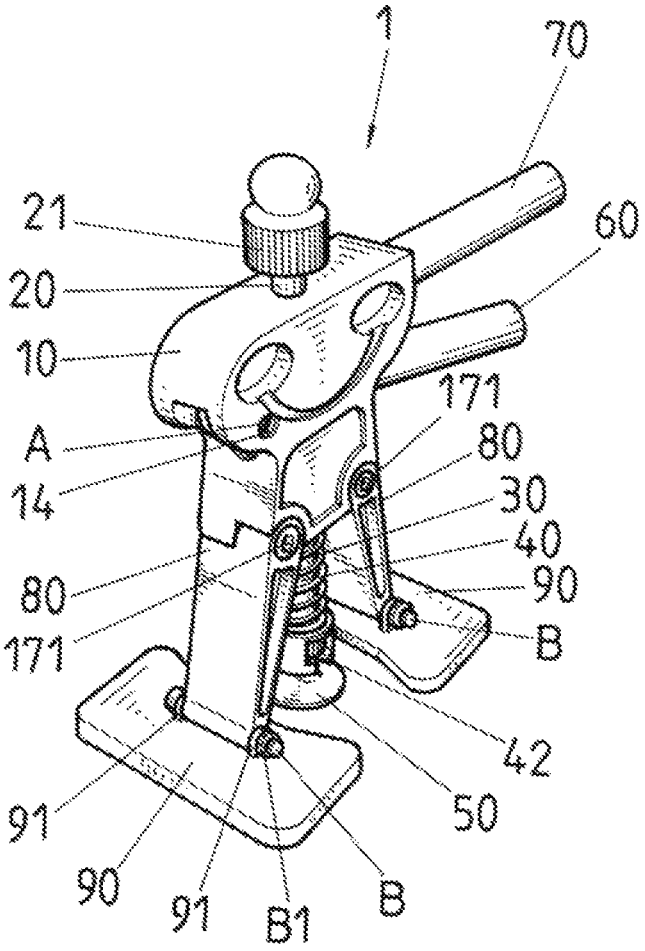
FIG. 1 shows a perspective view of the present invention.
Figure 2:
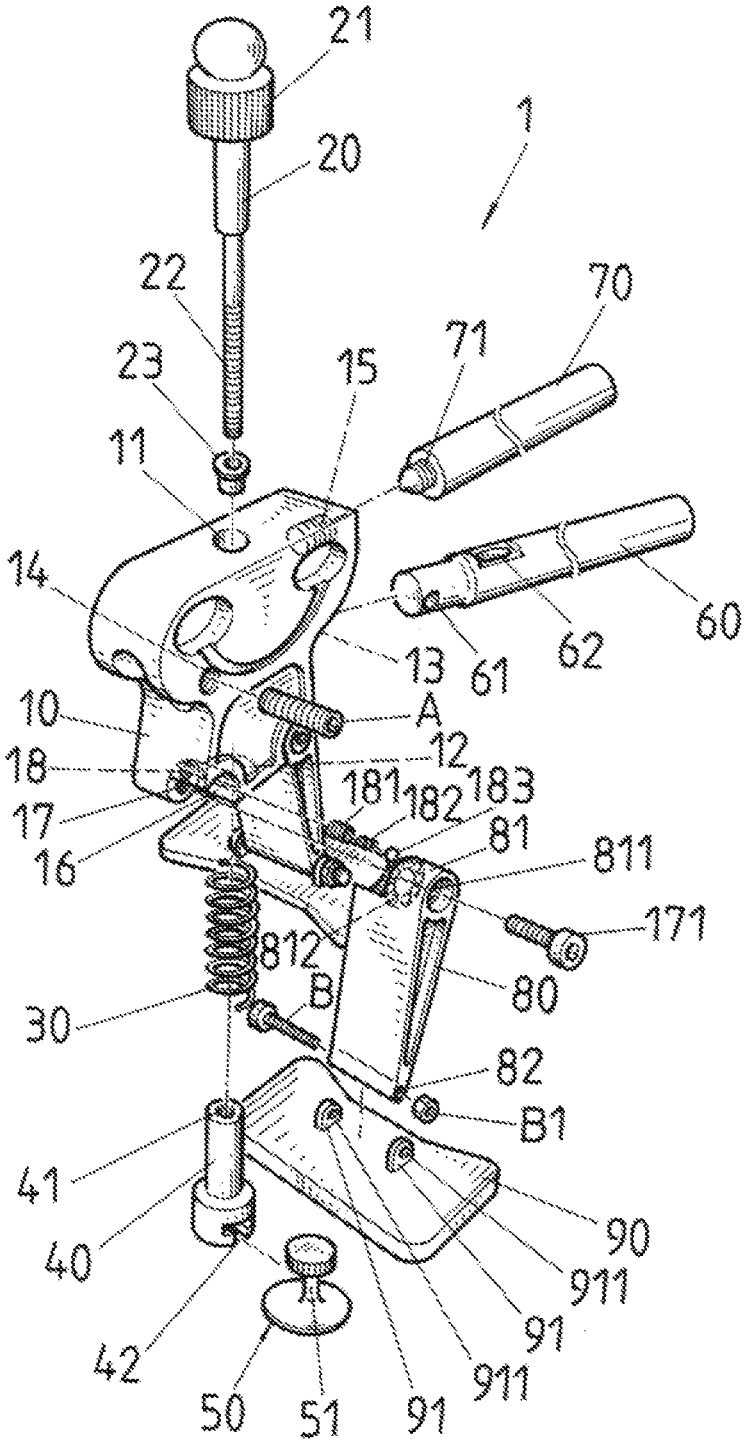
FIG. 2 shows a perspective view of components of the present invention.
Figure 3:
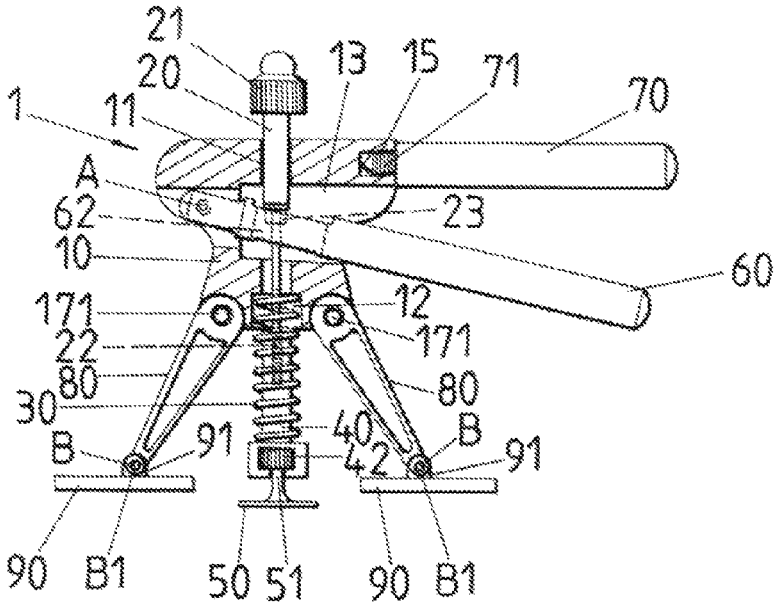
FIG. 3 shows a sectional view of the present invention.

Referring to FIGS. 1 to 3, it shows a repairing kit for automotive dents of the present invention. The repairing kit comprises:

a body 10, a center of the body 10 being provided with a through-hole 11, with that a bottom of the through-hole 11 is provided with a circular slot 12, an interior of the body 10 is provided with a hollowed-out member 13, an end of the hollowed-out member 13 is provided with a shaft hole 14, a side of the hollowed-out member 13 is provided with a bolt hole 15, two sides at a bottom of the hollowed-out member 13 are provided respectively with an arc-shaped slot 16, an interior of the arc-shaped slot 16 is provided with two threaded holes 17, 18, one threaded hole 17 provides for locking with a screw bolt 171, the other threaded hole 18 provides for locking with a bead tube 181, and an interior of the bead tube 181 is emplaced with a small spring 182 and beads 183;

a draw bar 20, the draw bar 10 penetrating the through-hole 11 of the body 10, with that a top end of the draw bar 10 is provided with a knob 21, a bottom end of the draw bar 10 is provided with a pole 22, and the pole 22 is sheathed with a sleeve 23;

a spring 30, the spring 30 being sheathed on the draw bar 20, with that a top end of the spring 30 is emplaced in the circular slot 12 of the body 10;

a pull seat 40, a threaded hole 41 in a center of the pull seat 40 providing for locking with the pole 22 of the draw bar 20, with that a bottom of the pull seat 40 is provided with a T-shaped slot 42;

a pull piece 50, the pull piece 50 being in a shape of a letter 1, with that the pull piece 50 can be a structure of all kinds of shapes and sizes, and a neck member 51 of the pull piece 50 is emplaced and fixed in the T-shaped slot 42 of the pull seat 40;

a grab bar 60, the grab bar 60 being emplaced in the hollowed-out member 13 of the body 10 from a side of the body 10, with that a shaft A penetrates a through-hole 61 at a front section of the grab bar 60 and is then locked in the shaft hole 14 of the body 10, a long hole 62 at a middle section of the grab bar 60 is penetrated by the draw bar 20 and the long hole 62 is abutted at the sleeve 23 of the draw bar 20 (as shown in FIG. 3);

a handle 70, an end of the handle 70 being provided with a screw 71, with that the screw 71 is locked in the bolt hole 15 of the body 10;

two foot stands 80, the foot stands 80 being installed at a bottom of the body 10 in a bilaterally symmetric way, and an end of the foot stand 80 being provided with a circular base 81, with that the circular base 81 is emplaced in the arc-shaped slot 16 of the body 10, the screw bolt 171 penetrates a through-hole 811 in a center of the circular base 81 and is then locked and positioned in the threaded hole 17, an interior of the circular base 81 is provided with a few locating holes 812 surrounding the through-hole 811, the locating holes 812 provide for latching selectively with the beads 183 for positioning, and a bottom of the foot stand 80 is provided with another through-hole 82; and two foot pieces 90, the foot pieces 90 being locked respectively at a bottom of the foot stands 80 and being provided with two bosses 91, with that a screw bolt B penetrates a through-hole 911 of the boss 91 and the through-hole 82 of the foot stand 80 and is then locked with a nut B1 at the other end.

Figure 4:
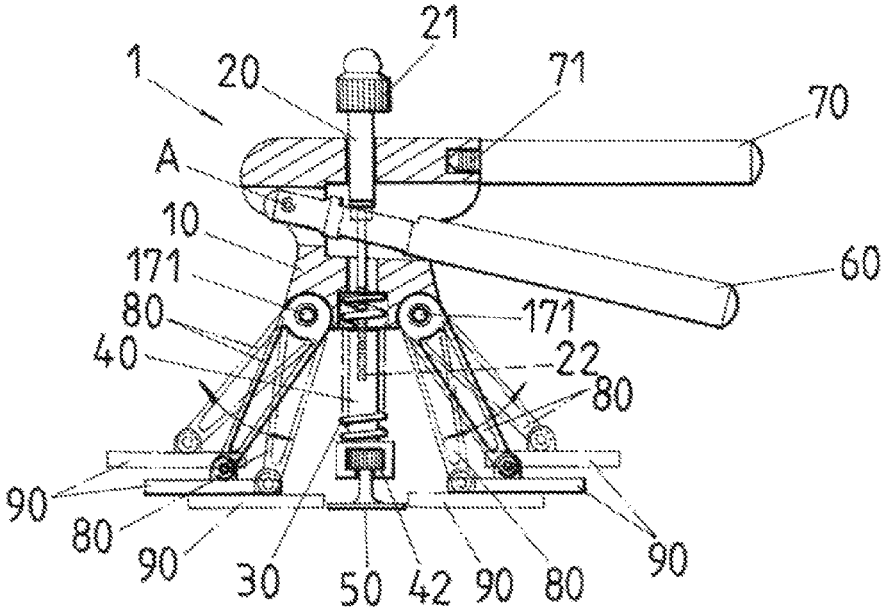
FIG. 4 shows a schematic view of adjusting transversal positions of foot stands and foot pieces, according to the present invention.

Referring to FIG. 4, a distance between two foot pieces 90 is adjusted according to shapes and sizes of automotive dents. To adjust the distance, a tool (such as wrench) is utilized to rotate loose the screw bolt 171 and then to toggle two foot stands 80, which adjusts positions of the beads 183 in the locating holes 812 of the foot stands 80, allowing the foot pieces 90 to attach flatly on an automotive sheet metal.

Figure 5:
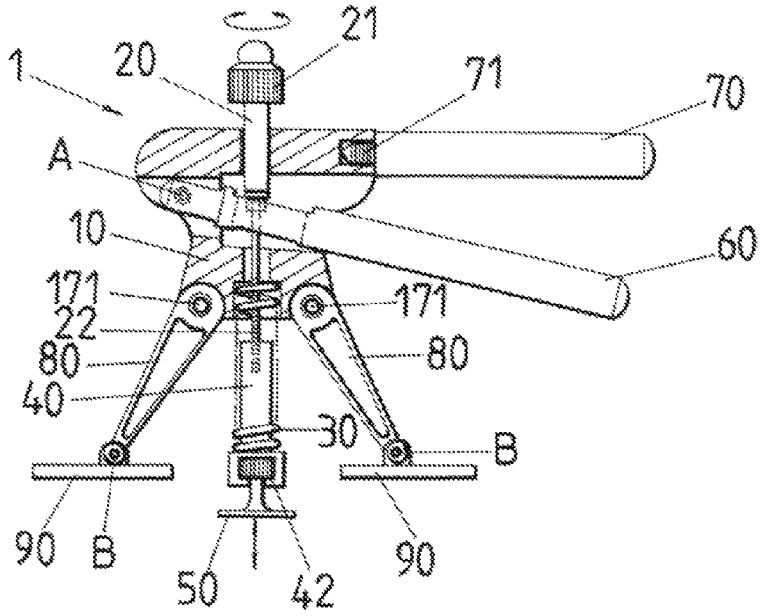
FIG. 5 shows a schematic view of adjusting heights of a pull seat and a pull piece, according to the present invention.

Referring to FIG. 5, a proper pull piece 50 is selected and is emplaced on the pull seat 40. Next, the knob 21 of the draw bar 20 is turned to drive the pull seat 40 to adjust its vertical position, allowing the pull piece 50 to attach flatly on an automotive dent.

Figure 6:
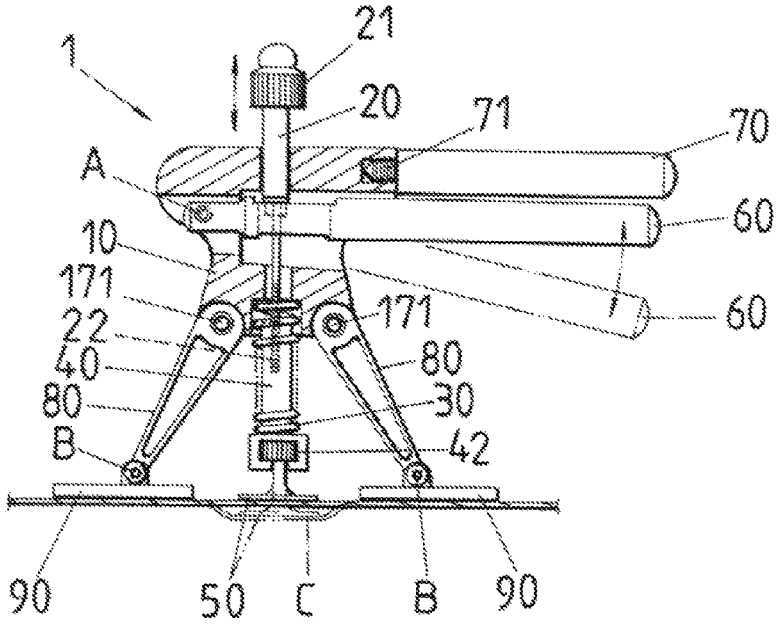
FIG. 6 shows a schematic view of repairing an automotive sheet metal, according to the present invention.

Referring to FIG. 6, after accomplishing the abovementioned operations, a user can hold with one hand the grab bar 60 and hit the handle 70 to drive upward the draw bar 20, the pull seat 40 and the pull piece 50. These operations are executed repeatedly until an automotive dent C is flattened out and restored to a smooth surface.

Accordingly, a user can use the present invention to repair automotive dents and restore a smooth surface to an automobile using a DIV method, without having to rely on an auto repair shop, wasting work, time and money.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A repairing kit for automotive dents, comprising:

a body, a center of which is provided with a through-hole, the through-hole having a bottom end with an enlarged bore, an interior of the body is provided with a hollow hollowed-out member, an end of the hollow is provided with a shaft hole and a side of the hollow is provided with a bolt hole;

a sleeve;

a draw bar, placed within and extending from the through-hole of the body, the draw-bar having a top end and a bottom end, the top end of the draw bar is provided with a knob, the bottom end of the draw bar extended through the sleeve a spring, the spring having a top end, the top end of the spring is in the bottom end of the through-hole of the body, and where the spring is seated on the drawbar;

a pull seat, comprising a threaded hole, the pull seat having a bottom, the bottom of the pull seat is provided with a T-shaped slot;

a pull piece, of an I shaped cross-section, the pull piece having a neck member, the neck member of the pull piece is fixed in the T-shaped slot of the pull seat; a grab bar, the grab bar having a front section with a through-hole and middle section with a long hole;

a shaft, passing through the through hole and having an end locked in the shaft hole of the body, a handle, an end of which is provided with a screw, the screw is locked in the bolt hole of the body;

two foot stands, which are installed at a bottom of the body; and two foot pieces, which are locked respectively at a bottom of the foot stand.

2. The repairing kit for automotive dents, according to claim 1, wherein two sides at a bottom of the body are provided respectively with an arc-shaped slot, an end of the foot stand is provided with a circular base that is emplaced in the arc-shaped slot of the body, and a through-hole in a center of the circular base, and a screw bolt.

3. The repairing kit for automotive dents, according to claim 2, wherein an interior side of the circular base comprising a plurality of locating holes that surround the through-hole.

4. The repairing kit for automotive dents, according to claim 1, wherein a bottom of the foot stand comprises a through-hole, and the two foot pieces comprise two bosses, wherein the bosses comprise a through-hole, a screw bolt, and a nut.

* * * * *